US009048607B2

(12) United States Patent
Ito

(10) Patent No.: US 9,048,607 B2
(45) Date of Patent: Jun. 2, 2015

(54) TERMINAL CRIMPING APPARATUS, METHOD OF MANUFACTURING TERMINAL CRIMPING ELECTRIC WIRE, AND TERMINAL CRIMPING ELECTRIC WIRE

(75) Inventor: Akira Ito, Yokkaichi (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 967 days.

(21) Appl. No.: 12/668,114

(22) PCT Filed: Feb. 8, 2008

(86) PCT No.: PCT/JP2008/052139

§ 371 (c)(1),
(2), (4) Date: Jan. 7, 2010

(87) PCT Pub. No.: WO2009/016850

PCT Pub. Date: Feb. 5, 2009

(65) Prior Publication Data

US 2010/0192366 A1 Aug. 5, 2010

(30) Foreign Application Priority Data

Aug. 2, 2007 (JP) ..... 2007-201903

(51) Int. Cl.
*H01R 43/048* (2006.01)
*H01R 4/18* (2006.01)
*H01R 43/058* (2006.01)

(52) U.S. Cl.
CPC ..... *H01R 43/058* (2013.01); *Y10T 29/53235* (2015.01); *H01R 4/185* (2013.01); *H01R 43/0488* (2013.01)

(58) Field of Classification Search
CPC .... H01R 43/058; H01R 43/048; H01R 43/04; H01R 4/184; H01R 4/185
USPC ..... 29/751, 753
See application file for complete search history.

(56) References Cited

U.S. PATENT DOCUMENTS 4,027,519 A * 6/1977 Bachle ..... 72/370.23
4,991,289 A * 2/1991 French ..... 29/863

(Continued)

FOREIGN PATENT DOCUMENTS

DE 4339749 A1 * 5/1995
GB 1157793 A * 7/1969

(Continued)

OTHER PUBLICATIONS

Machine Translation of DE4339749A1, obtained Feb. 6, 2013.*

(Continued)

*Primary Examiner* — Livius R Cazan
(74) *Attorney, Agent, or Firm* — Gerald E. Hespos; Michael J. Porco; Matthew T. Hespos

(57) ABSTRACT

A terminal crimping apparatus, which crimps a crimping part of a terminal onto a conductor at an end part of an electric wire, includes: an anvil which supports a bottom part of the crimping part in a mounted manner; and a crimper disposed so as to move in proximity to and apart from the anvil. A plurality of anvil-side crimping surfaces are formed in the anvil along a longitudinal direction of the conductor, the respective anvil-side crimping surfaces being formed so as to be continuous from each other without a step, in a substantially center part in a width direction thereof, along the longitudinal direction of the conductor and have curved surface shapes different from each other in both side parts thereof.

4 Claims, 6 Drawing Sheets

(56) References Cited

U.S. PATENT DOCUMENTS

| | | | | |
|---|---|---|---|---|
| 5,636,438 | A * | 6/1997 | Takagishi | 29/866 |
| 7,306,495 | B2 | 12/2007 | Hashimoto et al. | |
| 2002/0022414 | A1 * | 2/2002 | Kitagawa et al. | 439/877 |

FOREIGN PATENT DOCUMENTS

| | | |
|---|---|---|
| JP | 59-165390 | 9/1984 |
| JP | 60-47386 | 3/1985 |
| JP | 200550736 | 2/2005 |
| JP | 2005174896 | 6/2005 |
| JP | 2005327690 | 11/2005 |

OTHER PUBLICATIONS

Japanese Office Action.

Chinese Office Action.

Chinese Office Action of Aug. 29, 2012.

* cited by examiner

TERMINAL CRIMPING APPARATUS, METHOD OF MANUFACTURING TERMINAL CRIMPING ELECTRIC WIRE, AND TERMINAL CRIMPING ELECTRIC WIRE

BACKGROUND OF THE INVENTION

1. Field of the Invention

The present invention relates to a technology of crimping a terminal onto an electric wire.

2. Description of the Related Art

When a terminal such as a connector terminal is crimped onto an end part of an electric wire, it is an important goal to increase holding force therebetween and reduce connection resistance therebetween. Note that the holding force refers to force required for separating an end part of an electric wire and a terminal when they are applied with strength in a drawing direction, and that the connection resistance refers to a resistance value between the terminal and the electric wire.

The holding force has a tendency to increase as compressibility is gradually increased and decrease when compressibility reaches or surpasses a certain point.

In addition, the connection resistance shows a tendency to keep decreasing when compressibility is gradually increased and conversely increase when compressibility reaches or surpasses a certain point.

The same compressibility is not an optimum point for both, but a point at which the largest value of holding force is exhibited and a point at which the smallest value of connection resistance have compressibilities different from each other.

FIG. 12 is a figure illustrating a relationship between crimp height and holding force or connection resistance in a case where a terminal is crimped onto an end part of an electric wire. Herein, the crimp height (mm) represents a height of a crimper with respect to an anvil when the terminal is crimped using a crimping mold, in which there is established a relationship that compressibility is higher as the crimp height becomes smaller and lower as the crimp height becomes larger.

This figure shows a change curve C1 indicating holding force (at initial stage immediately after crimping), a change curve C2 indicating connection resistance (at initial stage immediately after crimping) and a change curve C3 indicating connection resistance (after endurance test) corresponding to a plurality of crimp heights H1 to H7.

As shown in this figure, it is understood that crimping is performed excessively in a case where the crimp height is small (H1 and H2), leading to a decrease in holding force. If force in a drawing direction is applied on the end part of the electric wire and the terminal on this occasion, the end part of the electric wire tends to be broken to be separated therefrom in a crimping portion. Meanwhile, relatively strong holding force can be obtained in a case where the crimp height is relatively appropriate (from H3 to H5). If force in a drawing direction is applied on the end part of the electric wire and the terminal on this occasion, the electric wire tends to be broken to be separated therefrom in a portion other the crimping portion. Moreover, it is understood that crimping is performed loosely in a case where the crimp height is large (H6 and H7), leading to a decrease in holding force. If force in a drawing direction is applied on the end part of the electric wire and the terminal on this occasion, the end part of the electric wire tends to come out of the terminal to be separated therefrom.

Besides, it is understood from this figure that connection resistance tends to be relatively large in the case where the crimp height is small (H1 and H2), relatively small in the case where the crimp height is relatively appropriate (from H3 to H5), and relatively large in the case where the crimp height is large (H6 and H7).

Therefore, it is possible to make relatively large holding force and relatively small connection resistance compatible with each other if crimping is performed within a medium level of compressibility range (in an example of FIG. 12, within the range of crimp height H3 to H5).

SUMMARY OF THE INVENTION

However, more specific study indicates a difference between the compressibility of a conductor which is suitable for obtaining large holding force and the compressibility of a conductor which is suitable for obtaining small connection resistance. For example, in the case shown FIG. 12, the crimp height suitable for obtaining large holding force is H5, whereas the crimp height suitable for obtaining small connection resistance is H3, where both are different from each other.

Accordingly, if the terminal can be crimped onto the electric wire with different compressibilities at a plurality of spots, it is possible to make large holding force and small connection resistance compatible with each other at high level.

For that purpose, there is assumed a technique of performing crimping with crimp heights different from each other, that is, compressibilities different from each other by providing a plurality of crimpers for terminal crimping.

However, in the case where a plurality of crimpers are provided as described above, it is required to control the crimp height individually, which is cumbersome in terms of manufacturing.

An object of the present invention is therefore to perform, when a terminal is crimped onto an end part of an electric wire, crimping with compressibilities different from each other at a plurality of spots without increasing control portions in manufacturing.

In order to solve the above-mentioned problem, according to a first aspect, a terminal crimping apparatus crimping a crimping part of a terminal onto a conductor exposed at an end part of an electric wire, the crimping part including a pair of crimping pieces provided in both side parts of a bottom part thereof, includes: a first die supporting the bottom part of the crimping part in a mounted manner; and a second die disposed so as to move in proximity to and apart from the first die and moving in proximity to the first die so that the pair of crimping pieces of the crimping part supported on the first die in the mounted manner are be deformed inward, to thereby crimp the crimping part supported on the first die in the mounted manner onto the conductor, wherein a plurality of crimping surfaces are formed in at least one of the first die and the second die along a longitudinal direction of the conductor, the respective crimping surfaces being formed so as to be continuous from each other without a step, in a substantially center part in a width direction thereof, along the longitudinal direction of the conductor and have curved surface shapes different from each other in both side parts thereof.

According to this terminal crimping apparatus of the first aspect, a plurality of crimping surfaces are formed, in at least one of the first die and the second die, along the longitudinal direction of the conductor, and the crimping surfaces are formed to be continuous from each other without a step in a substantially center part in the width direction thereof and have the curved surface shapes different from each other in both side parts thereof. Accordingly, the crimping part can be crimped with different compressibilities in the longitudinal direction of the conductor. In addition, it is only required to control a distance between the first die and the second die on this occasion, whereby spots to be controlled in manufacturing do not have to be increased.

Further, the respective crimping surfaces are continuous from each other without a step in the substantially center part in the width direction thereof, and thus the center part in the width direction of the crimping part can be made free from a step. Accordingly, fluctuations of a terminal position due to crimping are suppressed.

In the terminal crimping apparatus according to a second aspect, which is the terminal crimping apparatus according to the first aspect, the plurality of crimping surfaces are formed in the first die.

Further, according to the second aspect, a plurality of crimping surfaces are formed not in second die required to have fine surface roughness for deforming a pair of crimping pieces, but in the first die. Accordingly, it is also relatively easy to process the plurality of crimping surfaces.

According to a third aspect, a method of manufacturing a terminal crimping electric wire, for crimping a crimping part of a terminal onto a conductor exposed at an end part of an electric wire, the crimping part including a pair of crimping pieces provided in both side parts of a bottom part thereof, includes the steps of: supporting the crimping part on a first die in a mounted manner and disposing the conductor within the crimping part; and by using, as at least one of the first die and the second die, one in which a plurality of crimping surfaces are formed along a longitudinal direction of the conductor and the crimping surfaces are formed to be continuous from each other without a step, in a substantially center part in a width direction thereof, along the longitudinal direction of the conductor and have curved surface shapes different from each other in both side parts thereof, moving a second die in proximity to the first die so that the second die deforms the pair of crimping pieces inward and at least one of the first die and the second die deforms a bottom part of the crimping part to continue without a step, in a substantially center part in a width direction thereof, along a longitudinal direction of the conductor and have curved surface shapes different from each other at a plurality of spots, in both side parts thereof, along the longitudinal direction of the conductor, to thereby crimp the crimping part onto the conductor.

According to this method of manufacturing a terminal crimping electric wire of the third aspect, by using as at least one of the first die and the second die, one in which a plurality of crimping surfaces are formed along the longitudinal direction of the conductor and the respective crimping surfaces are formed so as to be continuous from each other without a step, in the substantially center part in the width direction thereof, along the longitudinal direction of the conductor and have curved surface shapes different from each other in the both side parts thereof, the second die is moved in proximity to the first die so that the second die deforms the pair of crimping surfaces inward and at least one of the first die and the second die deforms the bottom part of the crimping part to continue without a step, in the substantially center part in the width direction thereof, along the longitudinal direction of the conductor and have curved surface shapes different from each other at a plurality of spots, in the both side parts thereof, along the longitudinal direction of the conductor, to thereby crimp the crimping part onto the conductor. Accordingly, it is possible to crimp the crimping part with different compressibilities in the longitudinal direction of the conductor. In addition, it is only required to control the distance between the first die and the second die, whereby spots to be controlled in manufacturing do not have to be increased.

Further, the center part in the width direction of the crimping part is made free from a step, with the result that fluctuations of a terminal position due to crimping are suppressed.

A terminal crimping electric wire according to a fourth aspect includes: an electric wire in which a conductor is exposed at an end part thereof; and a terminal including a crimping part in which a pair of crimping pieces are provided in both side parts of a bottom part thereof, wherein the pair of crimping pieces are deformed inward, and the bottom part of the crimping part is deformed to continue without a step, in a substantially center part in a width direction thereof, along a longitudinal direction of the conductor and have curved surface shapes different from each other at a plurality of spots, in both side parts thereof, along the longitudinal direction of the conductor so that the crimping part is crimped onto the conductor.

According to this terminal crimping electric wire of the fourth aspect, the pair of crimping pieces are deformed inward, and the bottom part of the crimping part is deformed to continue without a step, in the substantially center part in the width direction thereof, along the longitudinal direction of the conductor and have curved surface shapes different from each other at a plurality of spots, in the both side parts thereof, along the longitudinal direction of the conductor. Accordingly, the configuration is made such that the conductor is compressed with different compressibilities at a plurality of spots along the longitudinal direction of the conductor. In addition, a plurality of crimping surfaces are formed in the die, whereby in crimping, the bottom portion thereof is processed in manners different from each other at a plurality of spots along the longitudinal direction of the conductor. Accordingly, it is only required to control the distance between two dies for crimping the crimping part, and thus spots to be controlled in manufacturing do not have to be increased.

Further, the crimping part continues without a step, in the substantially center part in the width direction thereof, along the longitudinal direction of the conductor, with the result that fluctuations of a terminal position due to crimping are suppressed.

These and other objects, features, aspects and advantages of the present invention will become more apparent from the following detailed description of the present invention when taken in conjunction with the accompanying drawings.

DETAILED DESCRIPTION OF THE PREFERRED EMBODIMENT

Hereinafter, a terminal crimping apparatus, a method of manufacturing a terminal crimping electric wire, and a terminal crimping electric wire according to an embodiment will be described.

Figure 1:
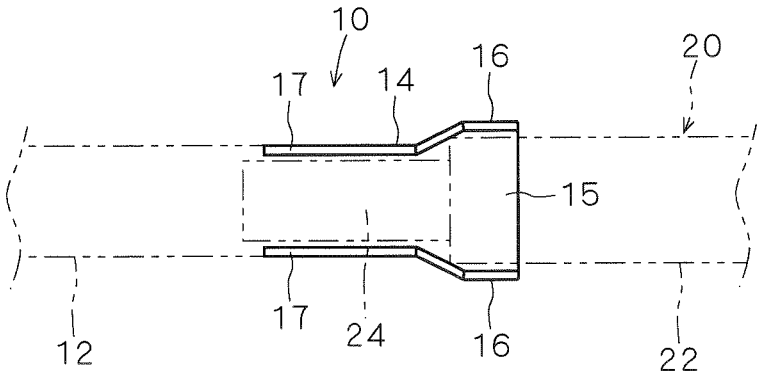
FIG. 1 is a plan view showing a terminal and an electric wire before crimping.
Figure 2:
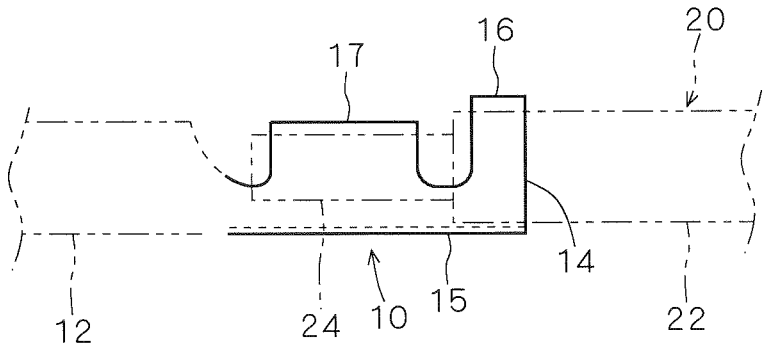
FIG. 2 is a side view showing the terminal and the electric wire before crimping.

First, a terminal and an electric wire before crimping will be described. FIG. 1 is a plan view showing a terminal 10 and an electric wire 20 before crimping, and FIG. 2 is a side view showing the terminal 10 and the electric wire 20 before crimping.

The terminal 10 is formed by, for example, appropriately performing punching and bending processing on a metal plate, and includes a terminal connection part 12 and a crimping part 14.

The terminal connection part 12 is a portion provided for connection to other conductive member. More specifically, in a case where the terminal 10 is a connector terminal, the terminal connection part 12 is formed into a male terminal connection part having a substantially rectangular plate-like shape or pin-like female terminal connection part having a substantially square cylinder shape or the like. Alternatively, the terminal connection part 12 may be formed into a substantially circular portion connected to other conductive member or the like by, for example, being screwed. Herein, description will be given by way of an example in which the terminal connection part 12 is formed into the female terminal connection part.

The crimping part 14 includes a bottom part 15, a pair of covering part crimping pieces 16 and a pair of conductor crimping pieces 17.

The bottom part 15 is formed in an elongated plate-like shape, and the pair of covering part crimping pieces 16 and the pair of conductor crimping pieces 17 are provided in both side parts on a base end side thereof (side on which the electric wire 20 extends) and both side parts on a tip end side thereof (terminal connection part 12 side), respectively. The crimping part 14 has, in plan view substantially orthogonal to a longitudinal direction of the terminal 10, a substantially U-shape cross section in each of a portion in which the pair of covering part crimping pieces 16 are provided and a portion in which the pair of conductor crimping pieces 17 are provided. Note that while there is a terminal without the above-mentioned pair of covering part crimping pieces 16, the present invention is also applicable to connection with such a terminal.

The electric wire 20 is obtained by covering a periphery of a conductor 24 of annealed copper, aluminum or the like with a covering part 22 of an insulating resin or the like. When the crimping part 14 is crimped, the covering part 22 having a predetermined length is peeled from the end part of the electric wire 20 in advance, and thus the conductor 24 having the predetermined length is exposed at the end part of the electric wire 20.

Then, in crimping the crimping part 14 onto the end part of the electric wire 20, first, the conductor 24 exposed at the end part of the electric wire 20 is disposed to be accommodated in the pair of conductor crimping pieces 17 portion within the crimping part 14, and an end part of the covering part 22 of the electric wire 20 is disposed to be accommodated in the pair of covering part crimping pieces 16 portion within the crimping part 14. In this state, such force that the pair of conductor crimping pieces 17 portion of the crimping part 14 are compressed in a vertical direction is applied thereon while causing the pair of conductor crimping pieces 17 to deform inward. Accordingly, this portion is crimped onto the exposed conductor 24, whereby there is established mechanical and electrical connection between the terminal 10 and the electric wire 20. Further, in the same state, such force that the pair of covering part crimping pieces 16 of the crimping part 14 are compressed in a vertical direction is applied thereon while causing the pair of covering part crimping pieces 16 to deform inward. Accordingly, this portion is crimped onto the end part of the covering part 22, and there is established mechanical connection between the terminal 10 and the electric wire 20.

Figure 3:
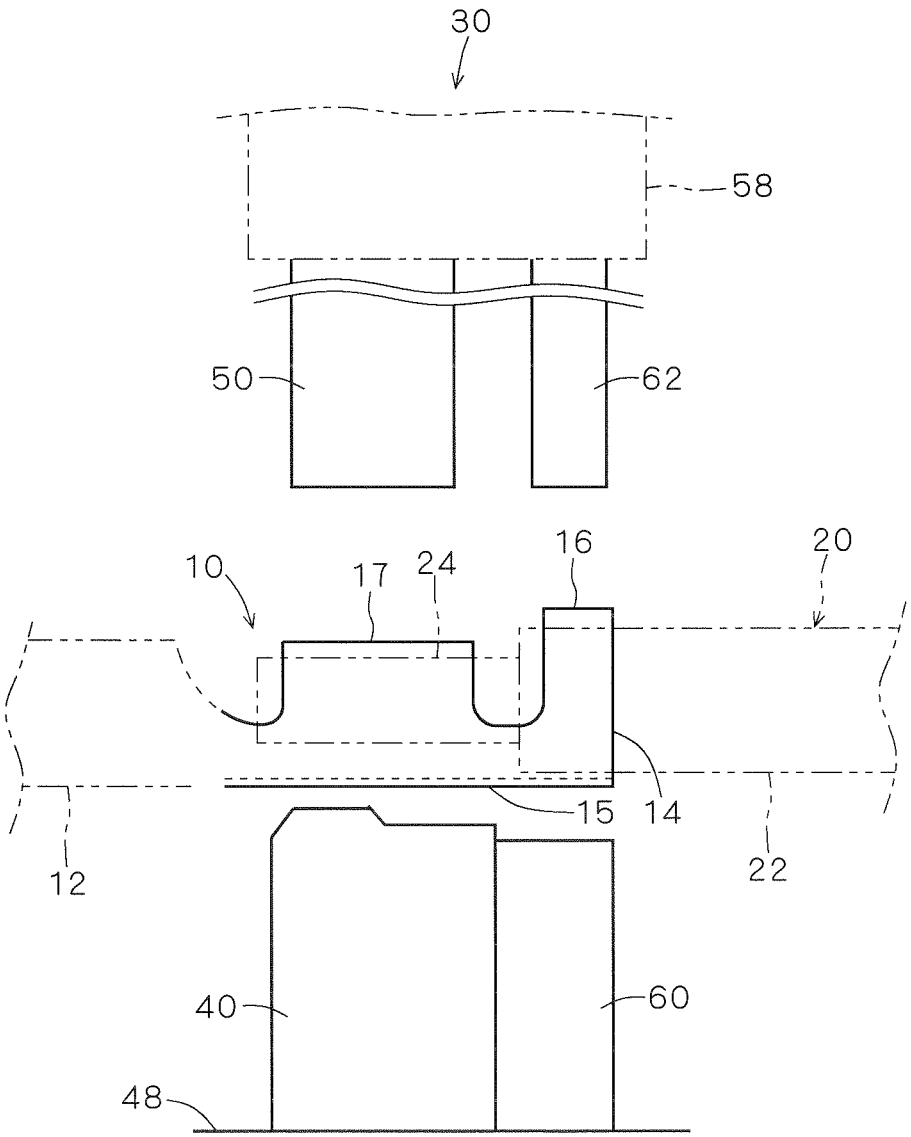
FIG. 3 is an explanatory view showing a terminal crimping apparatus according to an embodiment.
Figure 4:
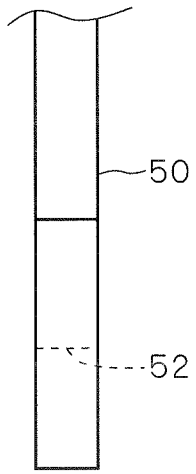
FIG. 4 is a side view showing a crimper of the terminal crimping apparatus.
Figure 5:
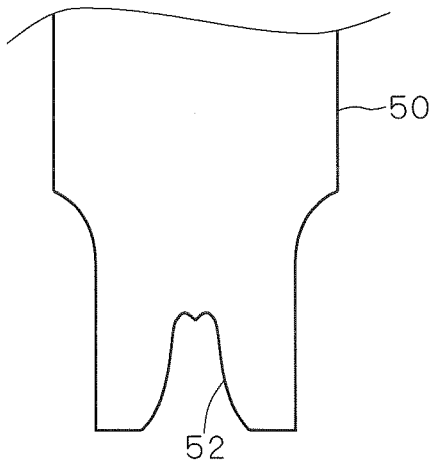
FIG. 5 is a front view showing the crimper of the terminal crimping apparatus.
Figure 6:
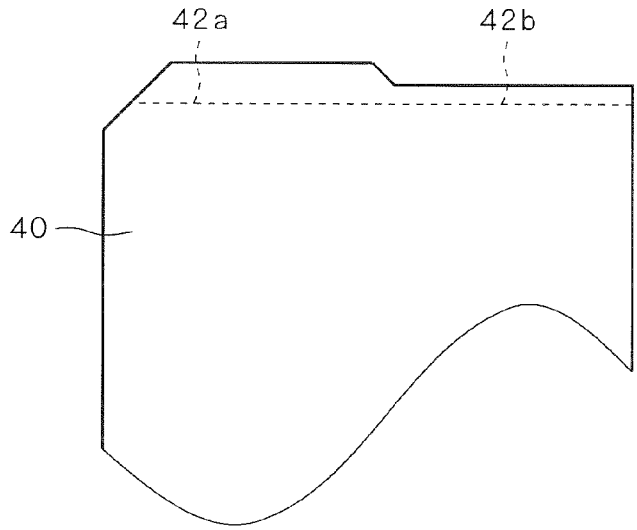
FIG. 6 is a side view showing an anvil of the terminal crimping apparatus.
Figure 7:
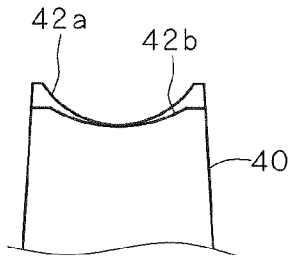
FIG. 7 is a rear view showing the anvil of the terminal crimping apparatus.

Next, the terminal crimping apparatus will be described. FIG. 3 is an explanatory view showing a terminal crimping apparatus 30, FIG. 4 is a side view showing a crimper 50 of the terminal crimping apparatus 30, FIG. 5 is a front view showing the crimper 50, FIG. 6 is a side view showing an anvil 40 of the terminal crimping apparatus 30, and FIG. 7 is a rear view showing the anvil 40.

This terminal crimping apparatus 30 is an apparatus for crimping the terminal 10 onto the conductor 24 exposed at the end part of the electric wire 20, and includes the anvil 40 serving as a first die and the crimper 50 serving as a second die.

The anvil 40 is mounted onto a base 48, and is configured so as to support the bottom part 15 of the crimping part 14 in a mounted manner.

The crimper 50 is disposed to be opposed to the anvil 40. Herein, the crimper 50 is disposed so as to move in proximity to and apart from the anvil 40 by an actuator 58 such as air cylinder and hydraulic cylinder above the anvil 40. The crimper 50 is caused to move in proximity to the anvil 40 in a state in which the crimping part 14 is supported on the anvil 40 in a mounted manner and the conductor 24 at the end part of the electric wire 20 is disposed in the crimping part 14, whereby the crimping part 14 is crimped onto the conductor 24.

Specific description will be given of crimping surface shapes of the anvil 40 and the crimper 50.

In the crimper 50, there is formed a crimper-side crimping surface 52 which extends from a tip end to a based end thereof in a notch shape, and this crimper-side crimping surface 52 is opposed to anvil-side crimping surfaces 42*a* and 42*b* described below (see FIG. 4 and FIG. 5). The deepest (top) part of the crimper-side crimping surface 52 is formed in a shape in which two arc-shaped peripheral surfaces each being convex upward are arranged side by side, and both side surfaces on a tip end side of the crimper-side crimping surface 52 are formed in a shape so as to expand gradually toward the tip end side. This crimper-side crimping surface 52 has the substantially same cross-sectional shape along a longitudinal direction of the conductor 24 to be disposed between the anvil 40 and the crimper 50. When the crimper 50 is caused to move in proximity to the anvil 40 in a state in which the crimping part 14 is supported on the anvil 40 in a mounted manner, the pair of conductor crimping pieces 17 are deformed so as to bend inward along the crimper-side crimping surface 52 while being in sliding contact with the crimper-side crimping surface 52.

In a tip end part (upper end part) of the anvil 40, a plurality of (herein, two) anvil-side crimping surfaces 42*a* and 42*b* are formed along the longitudinal direction of the conductor 24 to be crimped (see FIG. 6 and FIG. 7). The respective anvil-side crimping surfaces 42*a* and 42*b* are formed to be continuous from each other without a step, in a substantially center part in a width direction thereof (direction substantially orthogonal to both the longitudinal direction of the target conductor 24 and a moving direction of the crimper 50), along the longitudinal direction of the conductor 24 and to have curved-surface shapes different from each other in both side parts thereof. Herein, each of the anvil-side crimping surfaces 42*a* and 42*b* is formed in a shallow groove shape to bend in an arc manner with an axis in the substantially same direction as the longitudinal direction of the conductor 24 to be crimped being as a center. In addition, the anvil-side crimping surfaces 42*a* and 42*b* are formed in curved surface shapes different from each other. More specifically, the anvil-side crimping surfaces 42*a* and 42*b* are formed to have radii of curvature different from each other. Herein, the radius of curvature of the anvil-side crimping surface 42*a* on the tip end side of the terminal 10 to be crimped is smaller than the radius of curvature of the anvil-side crimping surface 42*b* on the base end side of the terminal 10 to be crimped.

The anvil-side crimping surfaces 42*a* and 42*b* are aligned at the substantially same height position in each of the substantially center parts in the width direction thereof. In other words, each of the anvil-side crimping surfaces 42*a* and 42*b* is formed to be flat in the substantially center part in the width direction thereof. Further, because of a difference in radius of curvature, the anvil-side crimping surfaces 42*a* and 42*b* are continuous from each other with a step in the both side parts in the width direction thereof.

When the crimping part 14 is crimped between the anvil 40 and the crimper 50, the crimping part 14 is deformed to a larger degree (that is, so as to have a relatively small radius of curvature) on the anvil-side crimping surface 42*a* side, and to a smaller degree (that is, so as to have a relatively large radius of curvature) on the anvil-side crimping surface 42*b* side. Besides, in this case, the substantially center part in the width direction of the bottom part 15 of the crimping part 14 is formed so as to continue without a step along the longitudinal direction of the conductor 24. Note that the anvil-side crimping surfaces 42*a* and 42*b* as described above are formed by, for example, cutting and processing a single member.

Further, a width dimension of the anvil 40 is formed so as to become gradually narrower toward the tip end side. Accordingly, the tip end side of the anvil 40 is smoothly inserted into a deep part within the crimper-side crimping surface 52 of the crimper 50 while holding the anvil 40 with sufficient strength.

On the base end side of the terminal 10 to be crimped, which is an opposing side of the anvil 40 and the crimper 50, an anvil 60 and a crimper 62 for covering part crimping are disposed, respectively, correspondingly to the pair of covering part crimping pieces 16 of the terminal 10. The anvil 60 is mounted onto the base 48, and the crimper 62 is disposed so as to move in proximity to and apart from the anvil 60 by the actuator 58. When the crimping part 14 is crimped onto the conductor 24 between the anvil 40 and the crimper 50, the crimper 62 also moves in proximity to the anvil 60, and the pair of covering part crimping pieces 16 are deformed inward so that the crimping part 14 is crimped onto the covering part 22 of the electric wire 20.

Description will be given of a method of manufacturing a terminal crimping electric wire by crimping the terminal 10 onto the electric wire 20 using the terminal crimping apparatus 30 configured in this manner.

First, the terminal 10 and the electric wire 20 shown in FIG. 1 and FIG. 2 are prepared. Then, in a state where the crimpers 50 and 62 are apart from the anvils 40 and 60, respectively, the crimping part 14 is supported on the anvils 40 and 60 in a mounted manner. After that, the end part of the electric wire 20 is disposed in the crimping part 14. In this case, the pair of conductor crimping pieces 17 portion of the crimping part 14 is mounted onto the anvil 40, and at the same time, the pair of covering part crimping pieces 16 portion of the crimping part 14 is mounted onto the anvil 60. In addition, the conductor 24 exposed at the end part of the electric wire 20 is disposed in the pair of conductor crimping pieces 17 portion, and the end part of the covering part 22 is disposed in the pair of covering part crimping part 16 portion.

Then, the crimpers 50 and 62 are moved in proximity to the anvils 40 and 60, respectively. After that, the pair of conductor crimping pieces 17 are deformed inward by the crimper 50. In addition, the crimping part 14 is deformed by the anvil-side crimping surfaces 42*a* and 42*b* in manners different from each other with compressive force between the crimper 50 and the anvil 40. That is, the anvil-side crimping surfaces 42*a* and 42*b* are formed in curved surface shapes different from each other, whereby the bottom part 15 of the crimping part 14 is deformed to deformation degrees different from each other at different positions along the longitudinal direction of the conductor 24. Accordingly, the portion of the crimping part 14, in which the pair of conductor crimping pieces 17 are provided, is deformed to a larger degree on the tip end side of the terminal 10, with the result that the conductor 24 is compressed to a relatively large degree, and deformed to a relatively small degree on the base end side of the terminal 10, with the result that the conductor 24 is compressed to a relatively small degree. In this case, the anvil-side crimping surfaces 42*a* and 42*b* are continuous from each other without a step, in the substantially center part in the width direction thereof, along the longitudinal direction of the conductor 24, and thus the bottom part 15 of the crimping part 14 is also formed, in the substantially center part in the width direction thereof, in a continuous manner without a step.

As a result, the portion of the crimping part 14, in which the pair of conductor crimping pieces 17 are provided, is crimped onto the conductor 24.

At the same time, between the crimper 62 and the anvil 60, the pair of covering part crimping pieces 16 portion of the crimping part 14 is crimped onto the covering part 22 of the electric wire 20.

Figure 8:
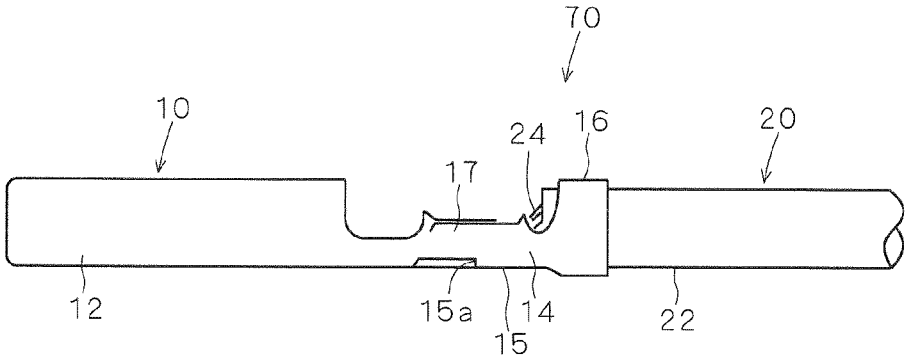
FIG. 8 is a side view showing a terminal crimping electric wire.
Figure 9:
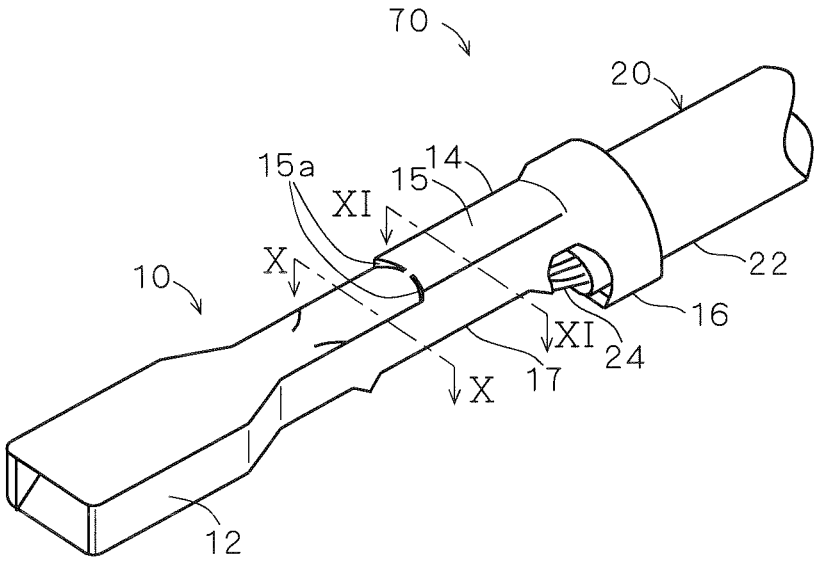
FIG. 9 is a perspective view showing the terminal crimping electric wire.
Figure 10:
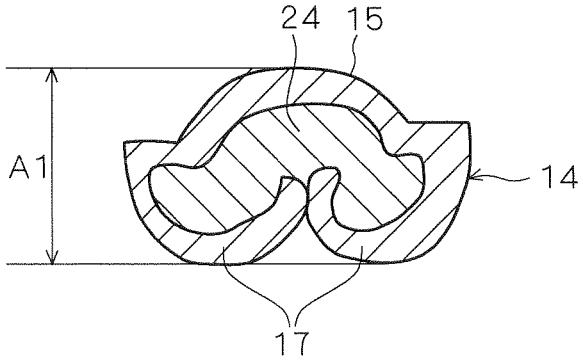
FIG. 10 is a sectional view taken along the line X-X of FIG. 9.
Figure 11:
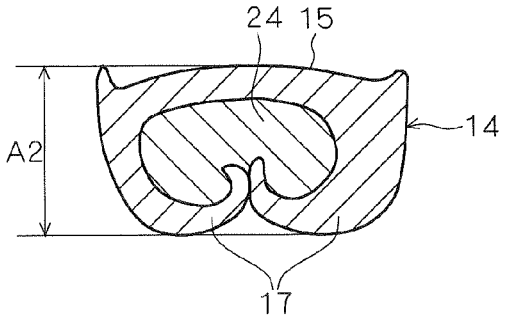
FIG. 11 is a sectional view taken along the line XI-XI of FIG. 9.
Figure 12:
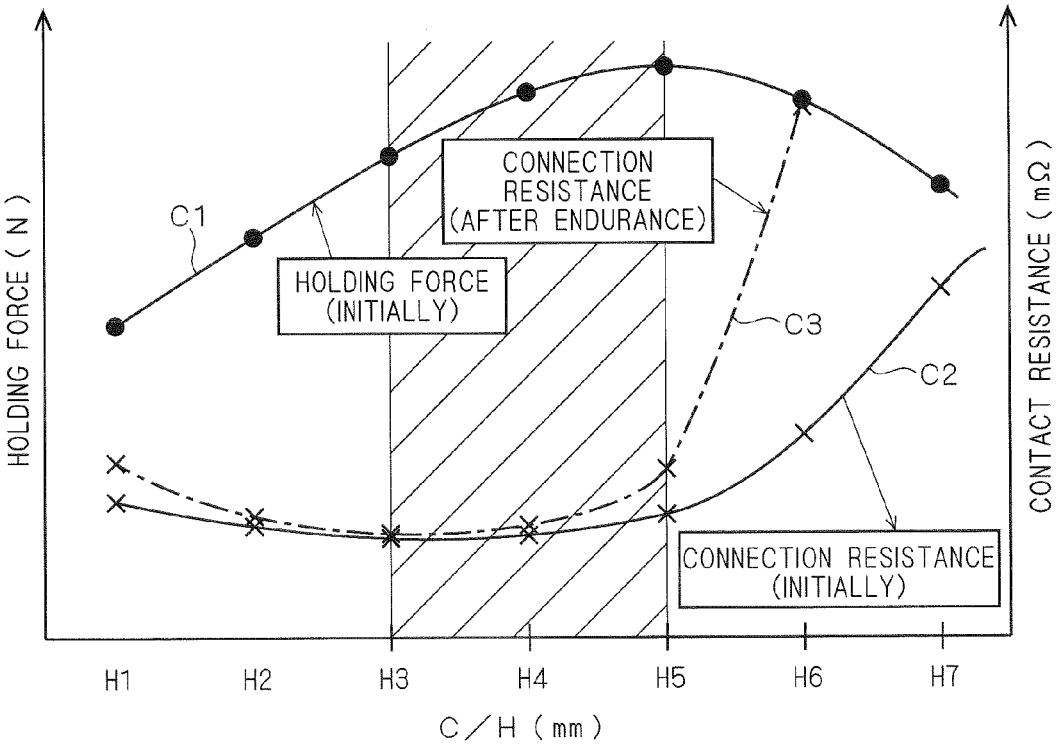
FIG. 12 is a figure showing a relationship between crimp height and holding force or connection resistance.

FIG. 8 is a side view showing a terminal crimping electric wire, FIG. 9 is a perspective view showing the terminal crimping electric wire, FIG. 10 is a sectional view taken along the line X-X of FIG. 9, and FIG. 11 is a sectional view taken along the line XI-XI of FIG. 9.

That is, in a terminal crimping electric wire 70 manufactured as described above, the pair of conductor crimping pieces 17 portion of the crimping part 14 is crimped onto the conductor 24, and the pair of covering part crimping pieces 16 portion of the crimping part 14 is crimped onto the covering part 22.

In the portion of the crimping part 14, which is crimped onto the conductor 24, the pair of conductor crimping pieces 17 are deformed inward in a curved shape to embrace the conductor 24. The bottom part 15 is deformed, at a plurality of spots (herein, two spots) along the longitudinal direction of the conductor 24, in manners (to deformation degrees) different from each other so as to compress the conductor 24 with compressibilities different from each other. More specifically, an outer surface of the portion of the bottom part, which is crimped onto the conductor 24, continues without a step in the substantially center part in the width direction thereof, and is deformed, in both side parts thereof, with radii of curvature different from each other in the plurality of spots (herein, two spots) along the longitudinal direction of the conductor 24 to continue with a step part 15*a*. A height dimension A1 of the tip end side portion in the portion of the crimping part 14, which is crimped onto the conductor 24, is substantially same as a height dimension A2 on the base end side of this part. The tip end side portion in the portion of the bottom part 15, which is crimped onto the conductor 24, is deformed to a degree larger than that of the base end side portion of this portion (that is, so as to have a smaller radius of curvature).

That is, in the tip end side portion of the terminal 10 of the crimping part 14, which is crimped onto the conductor 24, the conductor 24 has a relatively large compressibility, whereas in the base end side portion of the terminal 10 of the crimping part 14, which is crimped onto the conductor 24, the conductor 24 has a relatively small compressibility. Accordingly, in the former portion, the compressibility of the conductor 24 can be set to be relatively large in a manner suitable for obtaining small connection resistance, while in the latter portion, the compressibility of the conductor 24 can be set to be relatively small in a manner suitable for obtaining large holding force.

Note that force when the electric wire 20 is pulled mainly acts on the base end side portion of the terminal 10 of the crimping part 14, which is crimped onto the conductor 24, and thus the base end side portion is preferably set to have the compressibility of the conductor 24, which is suitable for obtaining large holding force.

According to the terminal crimping apparatus 30 thus configured and the method of manufacturing the terminal crimping electric wire 70, the anvil 40 includes a plurality of anvil-side crimping surfaces 42*a* and 42*b* along the longitudinal direction of the conductor 24 to be crimped. The respective anvil-side crimping surfaces 42*a* and 42*b* are formed to be continuous from each other without a step, in the substantially center part in the width direction thereof (direction substantially orthogonal to both the longitudinal direction of the conductor 24 to be crimped and the moving direction of the crimper 50), along the longitudinal direction of the conductor 24 and have curved surface shapes different from each other in both side portions thereof. For this reason, it is possible to crimp the crimping part 14 in the longitudinal direction of the conductor 24 with different compressibilities. Accordingly, it is possible to form a spot having a compressibility in which small connection resistance is obtained and a spot having a compressibility in which large holding force is obtained, with the result that small connection resistance and large holding force are easily compatible with each other.

Further, in this case, a plurality of anvil-side crimping surfaces 42*a* and 42*b* are provided in the anvil 40 made of a single member, whereby it is only required to control a distance between the anvil 40 and the crimper 50. Therefore, spots to be controlled in manufacturing do not have to be increased.

Further, the anvil-side crimping surfaces 42*a* and 42*b* are continuous from each other without a step in the substantially center part in the width direction thereof, and thus the center part in the width direction of the crimping part 14 is made free from a step. Accordingly, fluctuations of a terminal position due to crimping are suppressed. In other words, when the anvil-side crimping surfaces 42*a* and 42*b* are continuous from each other as a whole with a step, there is generated a positional deviation due to crimping by an amount of the step between the tip end part and the base end part of the terminal 10. As a consequence, deviation of the amount of the step causes troubles in connection between the terminal 10 and the terminal corresponding thereto, or necessitates the design or the like in which the deviation is taken into account. In this embodiment, however, the center part in the width direction of the crimping part 14 is made free from a step, whereby the positional deviation as described above can be suppressed. As a result, it is possible to easily establish connection to the corresponding terminal the like without, for example, making a design in which the deviation is taken into account.

Further, herein, a plurality of anvil-side crimping surfaces 42*a* and 42*b* are formed in the anvil 40, and thus the plurality of anvil-side crimping surfaces 42*a* and 42*b* are processed relatively with ease. That is, the crimper-side crimping surface 52 of the crimper 50 has a function of deforming a pair of conductor crimping pieces 17 inward while being in sliding contact therewith, and is accordingly required to have fine surface roughness so that the pair of conductor crimping pieces 17 are smoothly rubbed against the crimper-side crimping surface 52. For this reason, it is difficult to form a plurality of crimping surfaces in the crimper 50 and process those to be smooth. In contrast to this, the anvil 40 deforms only the bottom part 15 as described above, and accordingly may have coarser surface roughness compared with the crimper 50. Therefore, it is relatively easy to form a plurality of anvil-side crimping surfaces 42*a* and 42*b* in the anvil 40.

Further, as described above, it is possible to manufacture, by the above-mentioned terminal crimping apparatus 30 and manufacturing method, the terminal crimping electric wire 70 in which the crimping part 14 is crimped onto the conductor 24 in such a manner that the crimping part 14 is deformed to continue without a step, in the substantially center part in the width direction thereof, along the longitudinal direction of the conductor 24 and have curved surface shapes different from each other at a plurality of spots, in both side parts thereof, along the longitudinal direction of the conductor 24. Accordingly, the above-mentioned operation and effect are achieved.

Note that the above-mentioned anvil side-crimping surfaces 42*a* and 42*b* are not necessarily to be an arc-shaped periphery surface as long as they have curved surface shapes different from each other in the both side parts in the width direction thereof.

While the terminal crimping apparatus, the method of manufacturing a terminal crimping electric wire, and the terminal crimping electric wire have been described in detail, the forgoing description is in all aspects illustrative, and the present invention is not limited thereto. It is therefore understood that numerous modifications and variations not illustrated can be devised without departing from the scope of the invention.

The invention claimed is:

1. A terminal crimping apparatus for crimping a crimping part of a terminal onto an exposed conductor that is exposed from a covering part of an electric wire at an end part of the electric wire, the exposed conductor extending in a longitudinal direction and having a first section adjacent the covering part and a second section adjacent the first section and spaced from the covering part along the longitudinal direction, the crimping part including a pair of crimping pieces provided in both side parts of a bottom part thereof, comprising:

a first die supporting the bottom part of said crimping part in a mounted manner; and a second die disposed so as to move toward and apart from said first die, said second die being configured so that said crimping pieces of said crimping part supported on said first die are deformed inward as the second die is moved toward the first die to thereby crimp said crimping part onto said conductor, wherein said first die has first and second crimping surfaces disposed to align respectively with the first and second sections of the exposed conductor and being at different positions along the longitudinal direction of said exposed conductor, areas of the first and second crimping surfaces along a substantially widthwise center part of the first die being substantially linear and continuous with each other without a step along the longitudinal direction of said exposed conductor and being substantially parallel to the longitudinal direction of the exposed conductor, the crimping surfaces having concavely curved shapes at opposite widthwise sides of the center part of the first die, with the first crimping surface defining a first radius of curvature and the second crimping surface defining a second radius of curvature that is smaller than the first radius of curvature so that compression of the second section of the exposed conductor caused by the second crimping surface is greater than compression of the first section of the exposed conductor caused by the first crimping surface, thereby achieving a greater holding force at the first section of the exposed conductor than at the second section of the exposed conductor while also achieving a lower connection resistance at the second section of the exposed conductor than at the first section of the exposed conductor.

2. The terminal crimping apparatus of claim 1, wherein the concavely curved shapes at opposite widthwise sides of the center part of the first die are generated about axes extending substantially parallel to the longitudinal direction.

3. A method of manufacturing a terminal crimping electric wire, for crimping a crimping part of a terminal onto an exposed conductor that is exposed from a covering part of an electric wire at an end part of the electric wire, the exposed conductor extending in a longitudinal direction and having a first section adjacent the covering part and a second section adjacent the first section and spaced from the covering part along the longitudinal direction, the crimping part including a pair of crimping pieces provided in both side parts of a bottom part thereof, the method comprising the steps of:

supporting said crimping part on a first die in a mounted manner and disposing said exposed conductor within said crimping part, said first die having first and second crimping surfaces disposed to align respectively with the first and second sections of the exposed conductor and being at different distances from the covering part along the longitudinal direction of said exposed conductor and areas of said crimping surfaces along a substantially widthwise center part of the first die being substantially linear and continuous with each other without a step along the longitudinal direction of said exposed conductor and being substantially parallel to the longitudinal direction of the exposed conductor, the crimping surfaces having concavely curved shapes at opposite widthwise sides of the center part, with the first crimping surface defining a first radius of curvature and the second crimping surface defining a second radius of curvature that is smaller than the first radius of curvature; and moving a second die in proximity to said first die so that said second die deforms said crimping pieces inward and said first die deforms the bottom part of said crimping part to continue without a step, in a substantially center part in a width direction thereof, along the longitudinal direction of said exposed conductor and have curved surface shapes different from each other at a plurality of spots, in both side parts thereof, along the longitudinal direction of said exposed conductor, to thereby crimp said crimping part onto said exposed conductor, so that compression of the second section of the exposed conductor caused by the second crimping surface is greater than compression of the first section of the exposed conductor caused by the first crimping surface, thereby achieving a greater holding force at the first section of the exposed conductor than at the second section of the exposed conductor while also achieving a lower connection resistance at the second section of the exposed conductor than at the first section of the exposed conductor.

4. The method of claim 3, wherein the concavely curved shapes at opposite widthwise sides of the center part of the first die are generated about axes extending substantially parallel to the longitudinal direction.

* * * * *